US008870621B2

(12) United States Patent
Kaye

(10) Patent No.: US 8,870,621 B2
(45) Date of Patent: Oct. 28, 2014

(54) INERTIAL DYNAMIC TOY

(75) Inventor: Viktor Kaye, Moscow (RU)

(73) Assignee: OAK Novations, Ltd., Middlesex, NJ (US)

( * ) Notice: Subject to any disclaimer, the term of this patent is extended or adjusted under 35 U.S.C. 154(b) by 0 days.

(21) Appl. No.: 13/461,568

(22) Filed: May 1, 2012

(65) Prior Publication Data

US 2013/0225036 A1 Aug. 29, 2013

Related U.S. Application Data

(60) Provisional application No. 61/605,171, filed on Feb. 29, 2012.

(51) Int. Cl.
*A63H 1/00* (2006.01)

(52) U.S. Cl.
USPC ..... 446/233; 446/236

(58) Field of Classification Search
USPC ..... 446/233–236
See application file for complete search history.

(56) References Cited

U.S. PATENT DOCUMENTS

| | | | | | |
|---|---|---|---|---|---|
| 999,247 | A * | 8/1911 | O'Byrne | 446/233 |
| 1,495,911 | A * | 5/1924 | Lemoine | 434/302 |
| 2,747,326 | A * | 5/1956 | Doyle | 446/235 |
| 2,762,162 | A * | 9/1956 | Doljan | 446/233 |
| 2,767,514 | A * | 10/1956 | Hartman | 446/262 |
| 2,991,584 | A * | 7/1961 | Kaufman | 446/235 |
| 3,726,146 | A * | 4/1973 | Mishler | 74/5 R |
| 4,150,580 | A * | 4/1979 | Silkebakken et al. | 74/5 R |
| 5,681,248 | A * | 10/1997 | Vani | 482/126 |
| 6,053,846 | A * | 4/2000 | Lin | 482/44 |
| 6,461,276 | B1 * | 10/2002 | Yu | 482/44 |
| 6,527,675 | B1 * | 3/2003 | Yu | 482/44 |
| 7,326,156 | B2 * | 2/2008 | Dworzan | 482/110 |
| 2003/0129920 | A1 * | 7/2003 | Sze | 446/233 |

* cited by examiner

*Primary Examiner* — Gene Kim
*Assistant Examiner* — Alyssa Hylinski
(74) *Attorney, Agent, or Firm* — Joseph Stecewycz

(57) ABSTRACT

An inertial dynamic toy is disclosed comprising: an annular housing having a circumferential groove: a flywheel mounted to a flywheel support axle, the flywheel support axle configured to be retained inside the annular housing; and an outrigger support frame releasably attached to the annular housing.

4 Claims, 7 Drawing Sheets

INERTIAL DYNAMIC TOY

CROSS REFERENCE TO RELATED APPLICATION

The present application is related to Provisional Patent Application entitled "Inertial Dynamic Toy," filed Feb. 29, 2012 and assigned filing No. 61/605,171, and is incorporated herein by reference in its entirety.

FIELD OF THE INVENTION

This invention relates broadly to a dynamic toy and, more specifically to a toy including a gyroscopic wheel providing inertial energy for the movement and stabilization of the toy when in motion.

BACKGROUND OF THE INVENTION

Conventional toys using a gyroscopic component for providing energy to impart movement typically also include a reduction gearbox between the gyroscope and two drive wheels. This configuration results in a relatively complex drive system that may be subject to jamming, or gear slippage.

What is needed is a toy configuration in which a gyroscopic component may be utilized without a gearbox, in which toy movement may mimic actions of a top, and in which the toy may be used as a gyroscope.

BRIEF SUMMARY OF THE INVENTION

In one aspect of the present invention, an inertial dynamic toy comprises: an annular housing having a circumferential groove; a flywheel mounted to a flywheel support axle, the flywheel support axle configured to be retained inside the annular housing; and an outrigger support frame releasably attached to the annular housing.

in another aspect of the present invention, a method of imparting dynamic action to a toy comprises: providing a flywheel mounted to a flywheel support axle; securing the flywheel support axle to an annular housing such that the flywheel freely rotates along an axis of rotation coincident with the flywheel support axle; and attaching an outrigger support frame to the annular housing such that the flywheel and the outrigger support frame provide two-point support to the annular housing.

These and other features and advantages of the present invention will be more fully understood from the following detailed description with reference to the accompanying drawings.

BRIEF DESCRIPTIONS OF THE DRAWINGS

DETAILED DESCRIPTION OF THE INVENTION

Figure 1:
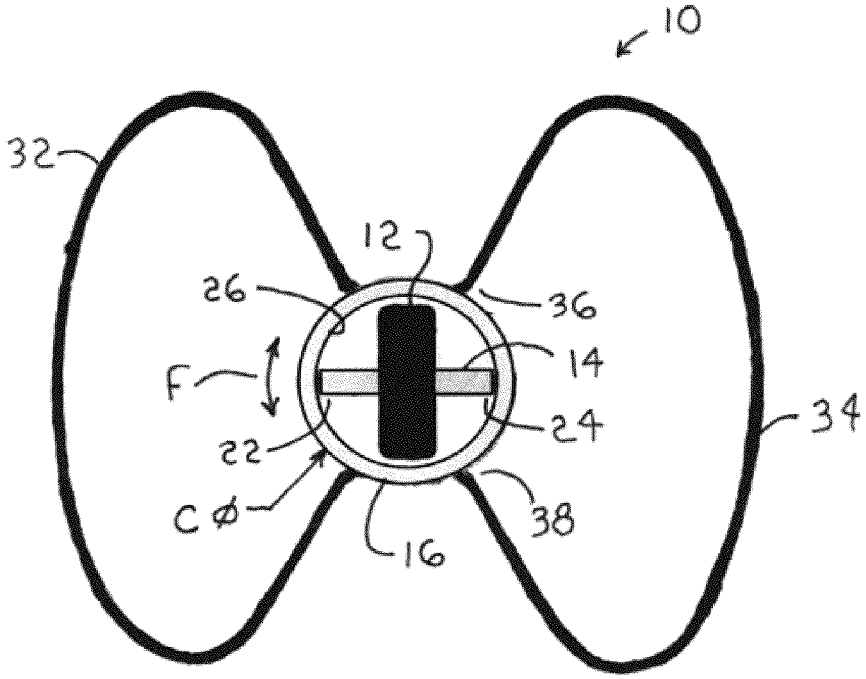
FIG. 1 is a diagrammatical plan view of an inertial dynamic toy showing a flywheel rotatably secured to an annular housing, in accordance with an embodiment of the present invention.

FIG. 1 shows an exemplary embodiment of an inertial dynamic toy 10 comprising a flywheel 12 rotatably mounted on a fixed flywheel support axle 14. In an exemplary embodiment, the flywheel support axle 14 may be secured to an annular housing 16 such that the flywheel 12 is free to rotate about a longitudinal axis of the flywheel support axle 14 which remains fixed within the annular housing 16. The ends 22, 24 of the flywheel support axle 14 may be retained in corresponding holes or recesses (not shown) in the annular housing 16, for example, to provide the requisite retention, as known in the art.

Alternatively, the inside surface 26 of the annular housing 16 may include raised areas (not shown) that fit into recesses (not shown) in the corresponding ends 22, 24 of the flywheel support axle 14, for example, so as to provide mechanical support. Either configuration will function to fix the flywheel support axle 14 in a predetermined position within the annular housing 16, while allowing the flywheel 12 to rotate freely with an axis of rotation coincident with the longitudinal axis of the flywheel support axle 14.

Figure 2:
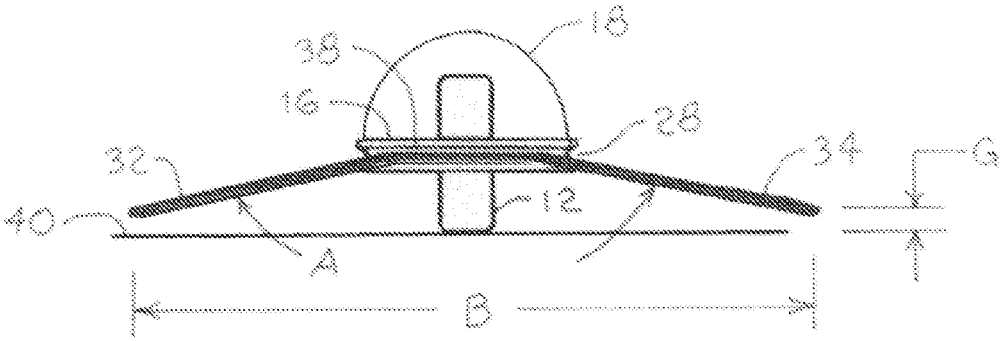
FIG. 2 is a diagrammatical front view of the inertial dynamic toy of FIG. 1 showing an outrigger support frame supporting the annular housing.
Figure 3:
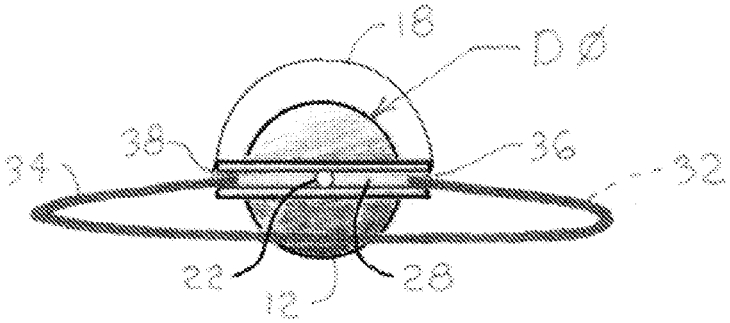
FIG. 3 is a diagrammatical side view of the inertial dynamic toy of FIG. 1 showing a dome cover attached to the annular housing.

The annular housing 16 may include a circumferential groove 28 having a substantially semicircular cross-sectional shape, as shown in FIGS. 2 and 3. A dome cover 18 may be provided as a protective enclosure for the annular housing 16. The dome cover 18 may be fabricated from a clear or tinted plastic material. The dome cover 18 may be secured to either the inside or the outside of the annular housing 16 by a frictional fit, as known in the art, or alternatively, the dome cover 18 may be bonded or glued to the annular housing 16 by an appropriate chemical compound.

The annular housing 16 may be supported, when placed on a surface, by means of an outrigger support frame 30 having a shape that generally resembles a figure eight, a butterfly, or a bowtie. The outrigger support frame 30 may include: (i) a first C-shaped fan-like section 32, (ii) a second C-shaped fan-like section 34, (iii) a first central curved section 36 attached to ends of the two C-shaped fan-like sections, and (iv) a second central curved section 38 attached to ends of the two C-shaped fan-like sections.

The first C-shaped fan-like section 32, the second C-shaped fan-like section 34, the first central curved section 36, and the second central curved section 38 may be formed from a single piece of rod or wire material to produce a unitary support component. Alternatively, the first C-shaped fan-like section 32, the second C-shaped fan-like section 34, the first central curved section 36, and the second central curved section 38 may comprise separate parts mechanically coupled together into an assembly using fasteners, brazing, soldering, or bonding, for example, with a butt joint or a lap joint configuration.

Either support configuration described above provides for a unitary wire-like component having the figure eight, butterfly, or bowtie shape. In an exemplary embodiment, the outrigger support frame 30 may comprise a heavy-gauge wire, or a plastic material, of from 1.0 mm to about 3.0 mm in diameter. The material for the outrigger support frame 30 is selected to provide a spring-like retention of the outrigger support frame 30 to the annular housing 16 without deformation, and also allow the annular housing 16 to be rotated within the outrigger support frame. 30.

Accordingly, the annular housing 16 may be removed from the outrigger support frame 30 by forcing the first central curved section 36 away from the second central curved section 38 such that the distance between the first central curved section 36 and the second central curved section 38 becomes larger than the diameter of the annular housing 16. By reversing the process, the first central curved section 36 and the second central curved section 38 may be placed back into the circumferential groove 28 and thus reassemble the inertial dynamic toy 10.

As can be appreciated by one skilled in the art, the flywheel 12 may perform three discrete functions. First, the flywheel 12 may function as a conventional wheel when the inertial dynamic toy 10 is moved across the support surface. Second, the flywheel 12 may provide physical support for the inertial dynamic toy 10 when at rest or otherwise in motion. Third, the flywheel 12 may function as a dynamic component in a gyroscope.

The flywheel 12 may function to convert the inertial dynamic toy 10 into a gyroscope after a user has placed the flywheel into a state of rotation by the impartation of a tangential force, or a push across the support surface. The inertial dynamic toy 10 is placed into an inverted orientation such that the inertial dynamic toy 10 rests on the dome cover 18. When the dome cover 18 is shaped as a hemisphere, as shown in the illustration, the inertial dynamic toy can spin about, or otherwise oscillate, depending upon the orientation of the inertial dynamic toy 10 when set down onto the support surface. Accordingly, a geometrical dome cover shape different from a hemisphere, such as a polygonal shape, can be used as an enclosure for the annular housing 16, provided that the spinning action of the flywheel 12 is not impeded by the dome cover. When the dome cover 18 has a polygonal shape (not shown), the inertial dynamic toy 10 may exhibit movements that differ from a configuration using a hemispherical dome cover 18.

As seen in the front view of FIG. 2, the first C-shaped fan-like section 32 forms a dihedral angle "A" of less than 180° with the second C-shaped fan-like section 34. That is, the cross sectional shape of the outrigger support frame 30, as taken through both the first C-shaped fan-like section 32 and the second C-shaped fan-like section 34, defines an obtuse angle. In an exemplary embodiment, the dihedral angle A may range from about 120° to 180°. Accordingly, the corresponding obtuse angle would similarly range from about 120° to 180°.

The two central curved sections 36, 38 are sized to fit into, and be retained within, the circumferential groove 18. The outrigger support frame 30 may be fabricated from a flexible rod-like material, such as a soft metal or a flexible plastic, so as to insure that the two central curved sections 36, 38 are held in place in the circumferential groove 18 by compressive, spring-like forces provided by the first C-shaped fan-like section 32 and the second C-shaped fan-like section 34.

As shown in FIGS. 2 and 3, the flywheel 12 extends below the plane of the outrigger support frame 30. This configuration allows the flywheel 12 to contact a support surface 40 and, when spinning, to impart motion to the inertial dynamic toy 10. This configuration also provides stability to the inertial dynamic toy 10 by means of the lateral support provided by the outrigger support frame 30. When the flywheel 12 is at rest, the flywheel 12 and the outrigger support frame 30 provide two-point support to the annular housing. That is, when the inertial dynamic toy 10 is lying at rest, the inertial dynamic toy 10 contacts the support surface 40 at: (1) a bottom region of the flywheel 12 and (2) a bottom surface of either the first C-shaped fan-like section 32 or the second C-shaped fan-like section 34.

In an exemplary embodiment, the flywheel 12 may have a diameter "D" of from about 30 mm to about 40 mm, and the outrigger support frame 30 may have an outer dimension "B" of from about 120 mm to about 200 mm. The resulting clearance between the outrigger support frame 30 and the support surface 40, indicated by dimension "G," may range from about 5 mm to about 0.5×D. The annular housing 16 may have an outside diameter "C" of from about 45 mm to about 70 mm.

It can be appreciated that the annular housing 16 can be rotated relative to the outrigger support frame 30, as indicated by arrow "F." This feature allows a user of the inertial dynamic toy 10 to vary the angular position of the flywheel 12 in the outrigger support frame 30, so as to produce various different modes of rocking motions of the inertial dynamic toy 10, such as side-to-side or front-to-back, when the flywheel 12 is spinning.

Figure 4:
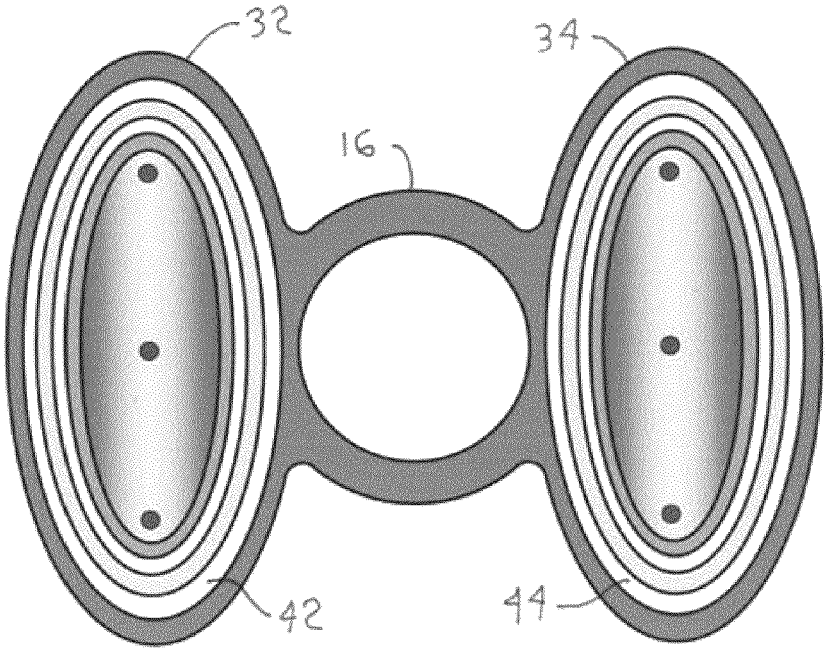
FIG. 4 is an alternate diagrammatical plan view of the inertial transportation toy of FIG. 1 showing an optional set of covers for the outrigger support frame.
Figure 5:
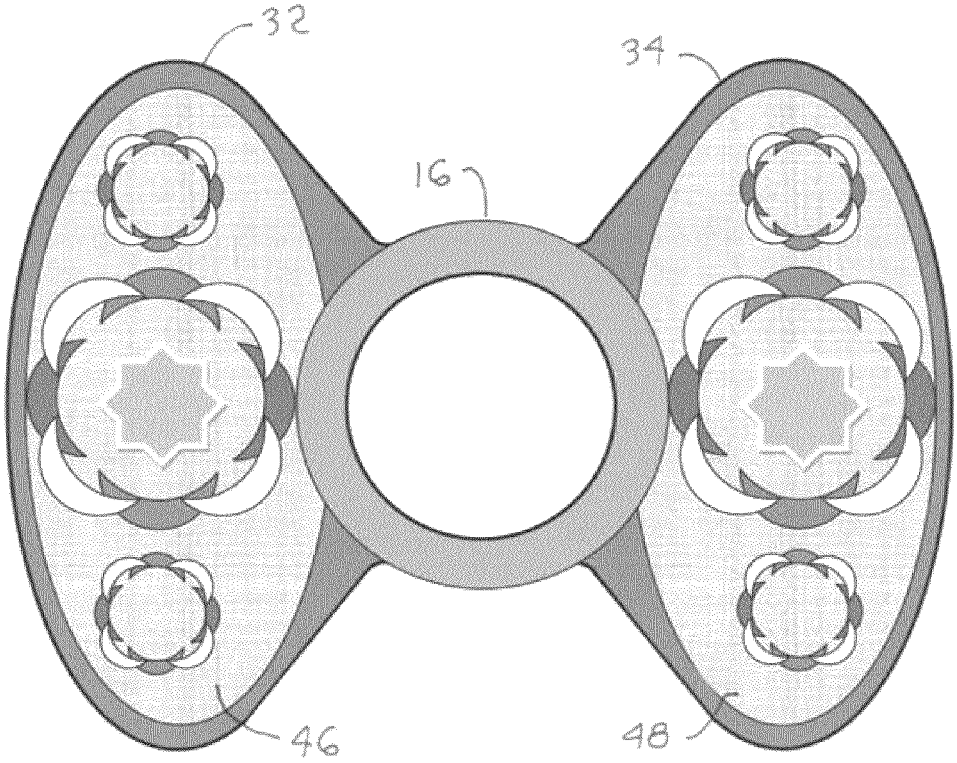
FIG. 5 is another alternate diagrammatical plan view of the inertial transportation toy of FIG. 4 showing an alternative pattern for the cover set.

In an exemplary embodiment, shown in FIG. 4, a first patterned cover 42, comprising an elliptical pattern, may be attached to and cover the first C-shaped fan-like section 32. Similarly, a matching second elliptically-patterned cover 44 may be attached to and cover the second C-shaped fan-like section 34. Alternatively, as shown in FIG. 5, a third patterned cover 46 may be provided on the first C-shaped fan-like section 32 in place of the first patterned cover 42, the pattern comprising a plurality of symbols and geometrical shapes. A matching fourth symbolic-patterned cover 48 may be provided on the second C-shaped fan-like section 34 in place of the second elliptically-patterned cover 44.

It should be understood that the present invention is not limited to the two patterns shown, and that other types and styles of patterns may be used to cover the first C-shaped fan-like section 32 and the second C-shaped fan-like section 34. The particular pattern used is limited only by the imagination of the designer of the inertial dynamic toy 10.

Figure 6:
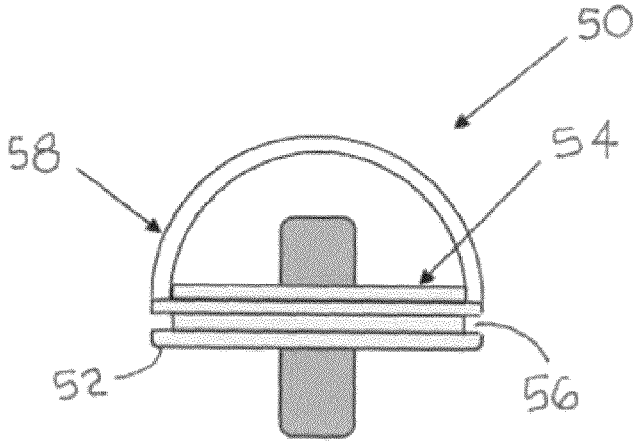
FIG. 6 is a diagrammatical front view of an alternative exemplary annular housing assembly.
Figure 7:
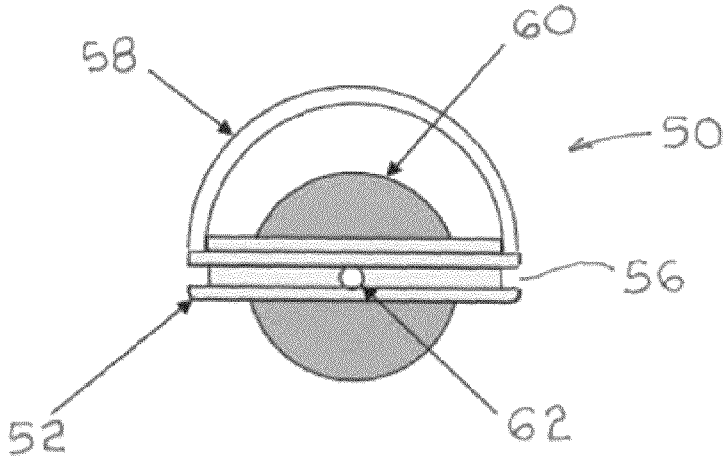
FIG. 7 is a diagrammatical side view of the annular housing assembly of FIG. 6.

In an exemplary embodiment, an inertial dynamic toy 10 may comprise an annular housing assembly 50, shown in FIGS. 6 and 7. An annular housing 52, in the annular housing assembly 50, may include an upper ridge 54 and a circumferential groove 56. The annular housing 52 may be fabricated from duralumin. A dome cover 58, here shown as comprising a hemispherical shape, may be secured to the upper ridge 54, by frictional fit or by adhesive means, such as by chemical bonding.

A flywheel 60 may be retained on a support axle 62. The flywheel 60 may have an outside diameter of approximately 30 mm and a thickness of about 10 mm. The support axle 62 may have a diameter of approximately 3 mm and a length of approximately 44 mm. The flywheel 60 may be loosely retained on the support axle 62 such that the flywheel 60 may rotate even if the support axle 62 is fixed in place. In an exemplary material, the flywheel 60 may be fabricated from a metal such as brass.

Figure 8:
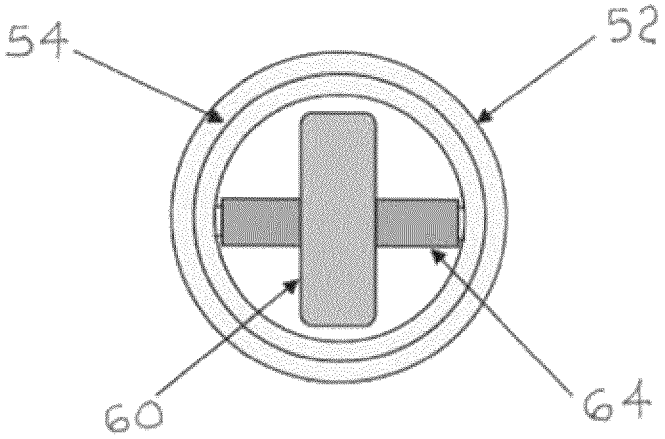
FIG. 8 is a diagrammatical top view of the annular housing assembly of FIG. 6.
Figure 9:
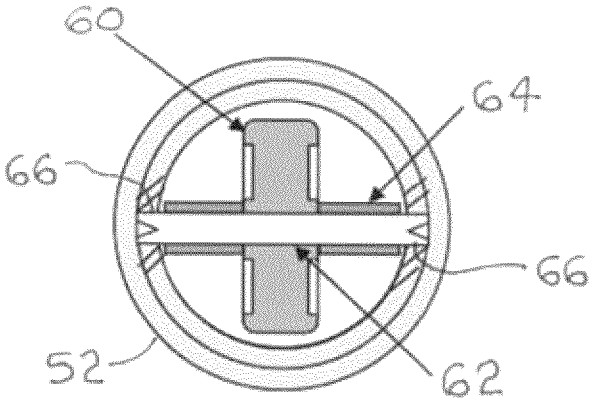
FIG. 9 is a diagrammatical top and partially sectional view the annular housing of FIG. 6.

As shown in FIGS. 8 and 9, there may be provided a pair of spacer sleeves 64, disposed on the support axle 62. The spacer sleeves 64 have an inside diameter slightly greater than the outside diameter of the support axle 62. In an exemplary embodiment, the spacer sleeve may be fabricated from a soft material, such as plastic, and have a length of approximately 12 mm, an outside diameter of approximately 6 mm, and an inside diameter of approximately 3 mm. This configuration insures that the flywheel 60 is maintained in position on the support axle 62, where the spacer sleeves 64 are loosely retained on the support axle 62 and free to rotate so as not to affect the rotation of the flywheel 60. An pair of openings 66 may be provided in the annular housing 52 to allow for insertion and retention of the support axle 62 when the inertial dynamic toy 10 is assembled.

Figure 10:
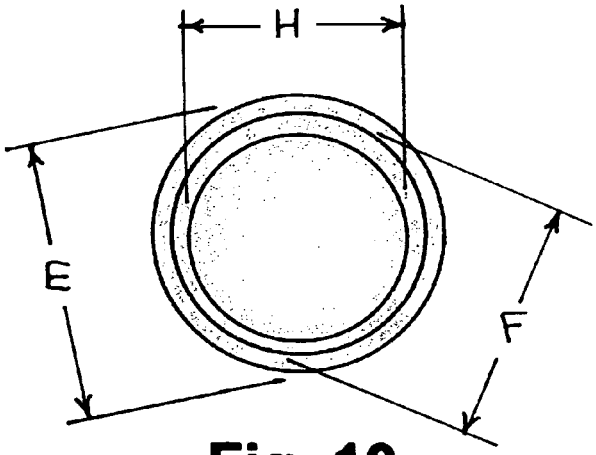
FIG. 10 is a diagrammatical top view of an annular housing as used in the annular housing assembly of FIG. 6.
Figure 11:
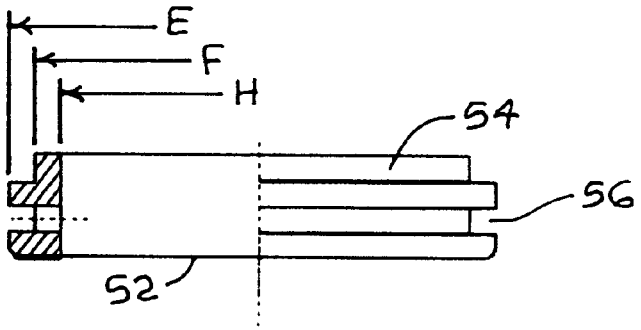
FIG. 11 is a detailed and partially sectioned view of the annular housing of FIG. 10.
Figure 12:
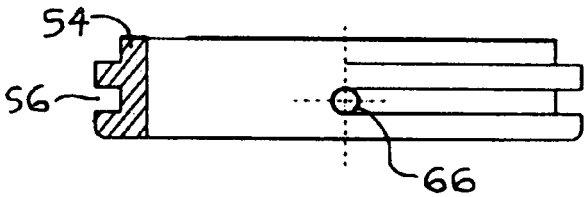
FIG. 12 is a detailed and partially sectioned view of the annular housing of FIG. 10.

In an exemplary embodiment, shown in FIGS. 10 and 11, the outer diameter of the annular housing 52 may be about 48 mm (dimension 'E'), and the outer diameter of the upper ridge 54 may have a diameter of about 44 mm (dimension 'F'). The inner diameter of the annular housing may be about 35 mm (dimension 'H'). The annular housing 52 may have an overall thickness of about 8 mm, with the circumferential groove having a width of approximately 2 mm. FIGS. 11 and 12 are detail, partially-sectional, views of the annular housing 52 showing the upper ridge 54, the circumferential groove 56, and the opening 66 for receiving the support axle 62.

Many of the specific details of certain embodiments of the invention are set forth in the above description and related drawings to provide a thorough understanding of such embodiments. One skilled in the art will understand, however, that the present invention may be practiced without several of the details described in the above description. Moreover, in the description, it is understood that the figures related to the various embodiments are not to be interpreted as conveying any specific or relative physical dimension.

What is claimed is:

1. An inertial dynamic toy comprising:

an annular housing having a circumferential groove;

a flywheel mounted to a flywheel support axle, said flywheel support axle configured to be retained inside said annular housing;

an outrigger support frame retained within said circumferential groove, whereby said outrigger support frame is releasably attached to said annular housing;

said outrigger support including a first C-shaped section, a second C-shaped section, a first central curved section connected to said first C-shaped section, and a second central curved section connected to said second C-shaped section;

wherein said first central curved section and said second central curved section are configured to fit into said circumferential groove; and wherein said first C-shaped section functions to provide a first compressive force to retain said outrigger support frame in said circumferential groove, and said second C-shaped section functions to provide a second compressive force to retain said outrigger support frame in said circumferential groove.

2. An inertial dynamic toy comprising:

an annular housing having a circumferential groove;

a flywheel mounted to a flywheel support axle, said flywheel support axle configured to be retained inside said annular housing;

an outrigger support frame retained within said circumferential groove, whereby said outrigger support frame is releasably attached to said annular housing;

said outrigger support including a first C-shaped section, a second C-shaped section, a first central curved section connected to said first C-shaped section, and a second central curved section connected to said second C-shaped section:

wherein said first central curved section and said second central curved section are configured to fit into said circumferential groove;

wherein said first C-shaped section functions to provide a first compressive force to retain said outrigger support frame in said circumferential groove, and said second C-shaped section functions to provide a second compressive force to retain said outrigger support frame in said circumferential groove; and wherein said first C-shaped section further forms a dihedral angle with said second C-shaped section, said dihedral angle comprising an angle of between 120° to 180°.

3. A method of imparting dynamic action to a toy, said method comprising the steps of:

providing a flywheel mounted to a flywheel support axle;

securing said flywheel support axle to an annular housing such that said flywheel freely rotates along an axis of rotation coincident with said flywheel support axle; and attaching an outrigger support frame to said annular housing by retaining said outrigger support frame within a circumferential groove in said annular housing, such that said flywheel and said outrigger support frame provide two-point support to said annular housing;

wherein said outrigger support frame comprises a first C-shaped section, said first C-shaped section functioning to provide a compressive force to retain said outrigger support frame on said annular housing.

4. A method of imparting dynamic action to a toy, said method comprising the steps of:

providing a flywheel mounted to a flywheel support axle;

securing said flywheel support axle to an annular housing such that said flywheel freely rotates along an axis of rotation coincident with said flywheel support axle;

attaching an outrigger support frame to said annular housing by retaining said outrigger support frame within a circumferential groove in said annular housing, such that said flywheel and said outrigger support frame provide two-point support to said annular housing;

wherein said outrigger support frame comprises a first C-shaped section, said first C-shaped section functioning to provide a compressive force to retain said outrigger support frame on said annular housing; and attaching a cover to said first C-shaped section.

* * * * *